United States Patent [19]

Matthews

[11] 4,159,029

[45] Jun. 26, 1979

[54] TOOL FOR APPLYING BUILDING SIDING

[76] Inventor: Freeman E. Matthews, Rte. 1, Sevierville, Tenn. 37862

[21] Appl. No.: 833,588

[22] Filed: Sep. 15, 1977

[51] Int. Cl.[2] ..... B23Q 3/00

[52] U.S. Cl. ..... 145/1 B; 269/321 S

[58] Field of Search ..... 145/1 A, 1 B; 33/188; 269/321 S

[56] References Cited

U.S. PATENT DOCUMENTS

| | | | |
|---|---|---|---|
| 823,378 | 6/1906 | Wagner | 33/188 |
| 1,031,854 | 7/1912 | Keyes | 145/1 A |
| 3,490,152 | 1/1970 | Printz | 269/321 S X |
| 3,953,015 | 4/1976 | Taylor et al. | 269/321 S X |

*Primary Examiner*—James L. Jones, Jr.
*Assistant Examiner*—James G. Smith

[57] ABSTRACT

A reusable tool for the installing of horizontal overlapping siding boards on a building framework. The disclosed tool comprises an elongated base member including a first end portion defining means for releasably engaging the upper edge of a siding board such that the base member depends from such upper edge and lies proximate to the exposed outer face of the board. The second end portion of the base member defines the lower extremity of the tool and pivotally receives an elongated arm means which is movable between multiple positions relative to the base member. In one such position, the arm is substantially parallel to the base member and in such position defines with the base a channel within which the bottom edge of a siding board is received and held relative to the subjacent board to which the siding tool is engaged. After the fresh board has been secured to the framework, the arm is pivoted to an angular position that permits the tool to be rotated about the longitudinal axis of the base member to disengage the tool from the subjacent board and to permit withdrawal of the tool from between the subjacent board and the freshly applied board.

8 Claims, 7 Drawing Figures

FIG. 4
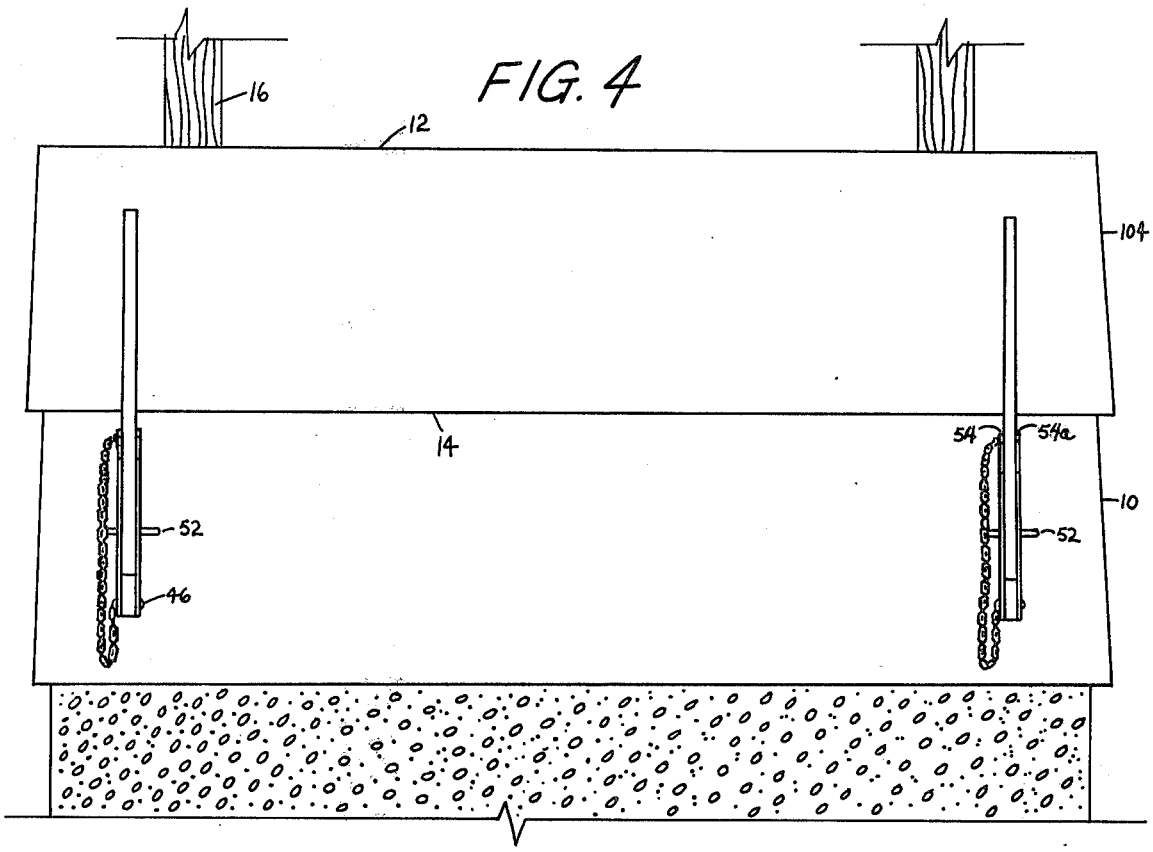
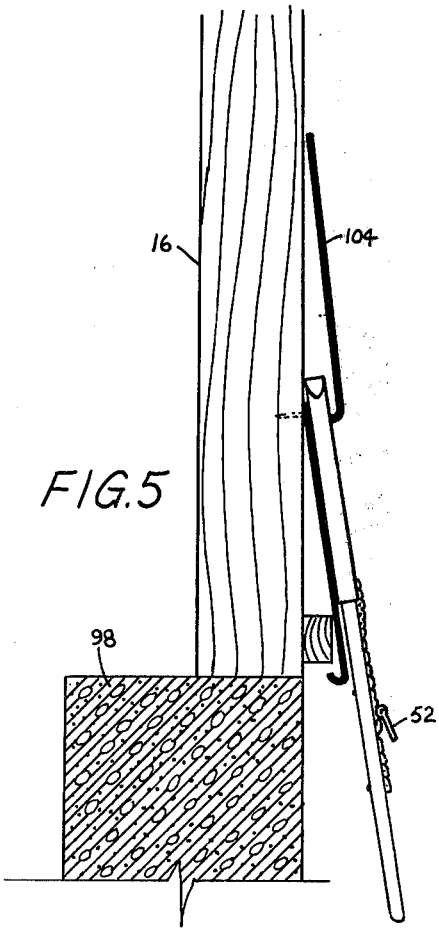
FIG. 5
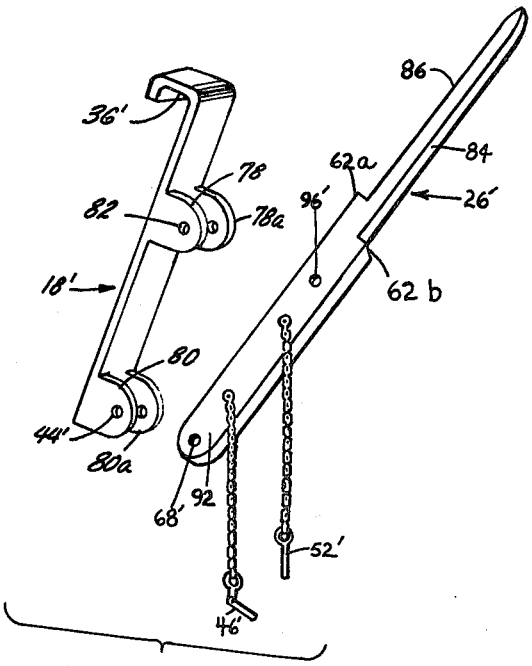
FIG. 6

TOOL FOR APPLYING BUILDING SIDING

The present invention relates generally to the installation of overlapping, elongated siding boards and more particularly to the provision of a reusable orienting and supporting tool to aid in such installation.

A building style which has remained quite popular over the years is that of frame structures, incorporating exteriors of generally parallel, horizontal, overlapping siding boards which are attached over a supporting framework. For various reasons, including the ease of maintenance, the trend has been to use siding boards made of metal, fiberglass or some other material rather than wooden boards, which have been used in the past. Regardless of the type of material used, there appears to have been no significant improvements in the means or methods for installing such siding over many years. Installation continues to require significant expense, either in materials or labor. For example, it is desirable for every board to overlap the subjacent board by an equivalent distance. This requires measuring for each board, which extends the time required to install each board and, therefore, increases labor expense.

The attaching means typically used for installation of siding are nails, which must be hammered, an operation generally requiring two free hands. In addition, at the same time, the installer must place the elongated board in its proper position on the wall and support it there during attachment. For aesthetic, as well as economic reasons, it is generally desired that individual boards (regardless of the composition) be as long as possible. Twelve foot lengths of siding are not uncommon and obviously are rather unwieldly for a single installer to position, support and attach, despite the relatively light weight of modern materials. It readily becomes apparent that more than one person, perhaps even three people, are required for the installation of siding.

Efforts have been made to reduce the labor requirements by special mating formation of the boards, by providing mating brackets which are first attached to the wall, or by a combination of formation and brackets. While special formation of the boards provides some aid in assuring proper orientation of the boards by insuring each board is parallel to its adjacent board, it does not solve the problem of supporting the board during nailing. It also requires either a separate forming step during the manufacture of the siding, such as providing a groove or notch in a board or providing an added lip or the like along one or both of the side edges of the siding. Either of these practices can add to the cost of producing siding boards and neither satisfactorily solves the installation problems.

Support and orientation have also been attempted by means of brackets which the installer must attach to the framework. The siding is then provided with a lip, or comparable construction feature which mates with the bracket to hold the siding board during attachment. The bracket is then incorporated into the structure. These brackets also suffer from a number of inadequacies. For example, the brackets must be carefully mounted to insure that they are level, i.e., at equivalent heights on different parts of the framework. Otherwise, the siding boards will not be parallel to one another, an aesthetically displeasing result. Also, labor expenses are increased because it is time-consuming to mount brackets and then install the siding. Further, it is expensive to incorporate the brackets, most of which are metal, into the structure.

Also, it is at times desirable to vary the amount of overlap of the board being attached and the subjacent strip or board. For example, the initial board is commonly attached to extend a substantial distance below the upper surface of the building foundation to prevent wind, dirt or water from penetrating into the structure. However, only a minimal amount of overlap is desired from one board to the next to avoid wasted material.

It is therefore an object of the present invention to provide a reusable tool for installing siding which allows a single operator to quickly and properly position a board, then have his hands free to secure the siding to the framework such as by nailing. It is also an object to provide a tool which is capable of selectively orienting a siding board in a plurality of positions providing different amounts of overlap over the subjacent board.

Other objects and advantages of the invention will become known by reference to the following description and the accompanying drawings.

In the drawings:

FIG. 4 is a front elevational view of two tools in position to support a length of siding;

FIG. 5 is a side elevational view of a tool during withdrawal from its position of support for a length of siding;

FIG. 6 is a perspective view of an alternative embodiment of a tool embodying various of the features of the invention.

Figure 1:
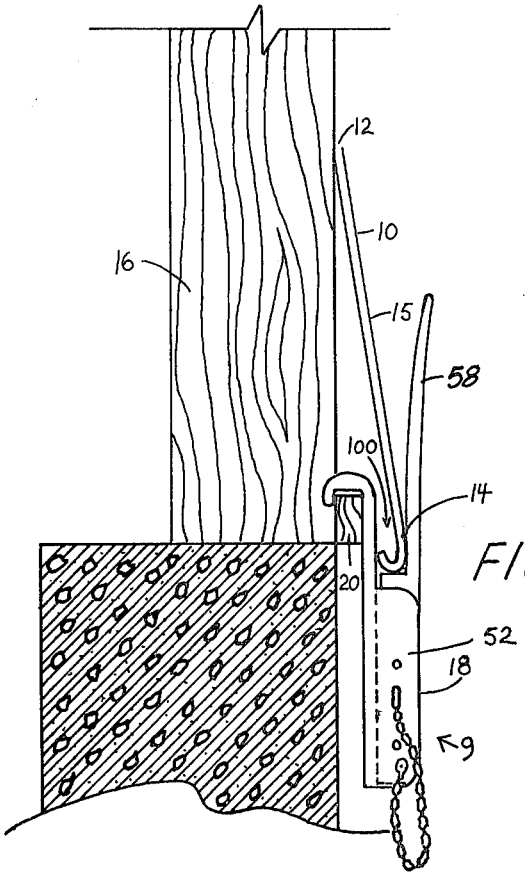
FIG. 1 is a side elevational view of a tool embodying various of the features of the invention, in a lower closed position.

In accordance with the present disclosure, there is provided a reusable tool 9 for installing horizontal overlapping siding boards 10 on a building framework 16. Each of the siding boards includes an upper edge portion 12, a lower edge portion 14 and an exposed outer face 15. The disclosed tool comprises an elongated base member 18 including a first end portion 30 defining means 36 for releasably engaging the upper edge portion 12 of the siding board such that the base member 18 depends from such upper edge and lies proximate to the exposed outer face 15 of the board. The second end portion 22 of the tool defines the lower extremity of the base member 18. Further, the tool includes an elongated arm means 26 adjustably received by the second end portion 22 of the base member 18 for movement of the arm means 26 between multiple positions relative to the base member 18. The positions of the arm 26 include an open position, a lower closed position and an upper closed position, in each of which closed positions the arm is substantially parallel to the base member 18. Lug means 32 are provided extending outwardly from the base member in a direction away from the exposed face 15 of the board. Further means such as a pin 52 are provided for releasably securing the arm to the lug in a closed position to define a channel between the arm and base suitable to receive therein the lower portion 14 of a board. In a preferred operation, one of the tools is deployed at one end of an elongated siding board and a second such tool is deployed at the opposite end of the board to thereby hold the board in its desired horizontal position for nailing or otherwise attaching the board to the framework. After the board has been secured to the framework, the arm 26 is moved to an open position that permits the tool to be rotated about the longitudinal axis of the base member 18 to disengage the tool from the subjacent board and to permit withdrawal of the tool from between the subjacent board and the freshly applied board. This process is repeated during the application of subsequent boards.

Referring to the Figures, in one embodiment, the disclosed tool 9 comprises an elongated base member 18 having an upper end portion 30 which in the illustrated embodiment, defines a hook 36. As shown in FIGURES 1 and/or 2, this hook is adapted to engage the upper edge of a wood starter strip 20 or a previously attached siding board 10 such that the base 18 depends from the upper edge of the strip (see FIG. 1) or siding board (see FIG. 2) and lies along the outer exposed face 15 of the board 10, for example. Lateral lug panels 32 and **32*a* extend outwardly from the base 18 on opposite sides of the base and away from the face 15 of the siding board 10 to define a channel 33** therebetween.

In the bottom portions 22 and **22*a*, the lug panels 32 and 32*a* are each pierced twice to provide a pair of longitudinally spaced-apart openings through each of the lug panels, each of these openings 44 and 45 through the panel 32 being in alignment with the corresponding opening 44*a* or 45*a* (not shown) in panel 32*a*. The lug panels further include an opening 48 through the thickness of the lug panel 32, such opening 48 being disposed at a longitudinal distance from the openings 44 and 45, approximately at the middle of the panel 32. The lug panel 32 further includes another opening 50 through the thickness thereof at a location longitudinally spaced from the opening 48. The distance between the centers of the openings 48 and 50 is the same as the distance between the openings 44 and 45. As desired, the lug panel 32*a* is provided with openings 48*a* and 50*a***, (not shown) respectively.

An elongated arm 26 is pivotally secured between the lug panels 32 and **32*a* by means of a pivotal lockpin 46 inserted through either the openings 44 and 44*a* or 45 and 45*a* in the lug panels. This arm 26 is adapted to be pivoted relative to the base member 18 and to be received within the channel 33. As shown in the Figures, the arm 26 preferably is substantially longer than the base member 18 and has its outboard end 58 tapered in a direction away from the base member 18. The arm 26 further is provided with openings 68 and 96 through the thickness thereof, longitudinally spaced from one another a distance substantially equal to the distance between the centers of the openings 44 and 48 (The centers of the openings 45 and 50 are equally spaced). It will be recognized that when the opening 96 is in register with the opening 48 (when the pivotal pin is inserted through opening 44), a locking pin 52 inserted through the opening 48 engages the opening 96 to lock the arm relative to the base 18. This lower closed position of the arm is shown in FIG. 1. When the pivot pin 46 is inserted through the openings 45, 68 and 45*a* of the base member 18 such that the opening 96 comes in register with the opening 50, the locking pin 52 is inserted through the opening 50 to engage the opening 96 to lock the arm in an upper closed position with respect to the base 18 in the position in FIG. 2**.

Figure 2:
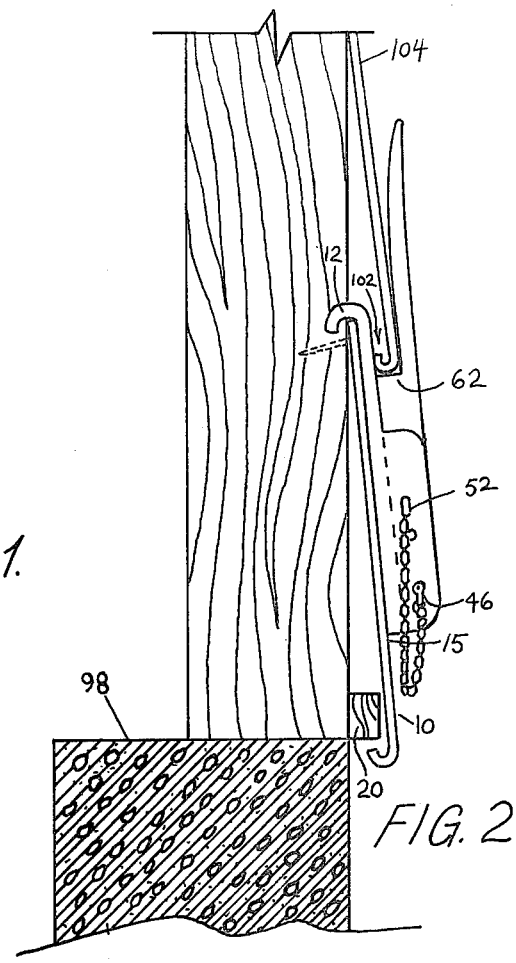
FIG. 2 is a side elevational view of the tool shown in FIG. 1 in an upper closed position.

Referring to FIG. 1, it is noted that the arm 26 is further provided with a shoulder 62 such that when the arm 26 is locked in either of the positions shown in FIGS. 1 and 2, the upper end 58 of the arm, the shoulder 62 and the base 18 cooperatively define a channel 102 in which there is received the bottom edge 14 of a siding board 10.

As shown in FIGS. 1 and 2, it is commonly desired that the overlap of the first siding board relative to the top edge of the foundation be less than the overlap of a siding board relative to its subjacent siding board, or in certain instances, the thickness of the starter strip 20 is significantly greater than the thickness of a typical siding board such that the radius of the hook 36 will not permit the hook to fully fit over the top edge of the starter strip. For accommodating these and/or other instances, the arm 26 of the disclosed tool is positionable as described above and shown in FIGS. 1 and 2 to establish different suitable vertical distances between the top edge of the starter strip or siding board and the bottom edge of the freshly applied siding board. In the depicted embodiment, these two different positions of the arm 26 provide about one-half inch difference in such vertical distances, a distance greater than the length of the lip 37 of the hook 36. Other differences are readily obtainable in like manner as will be recognized by a person skilled in the art.

Figure 3:
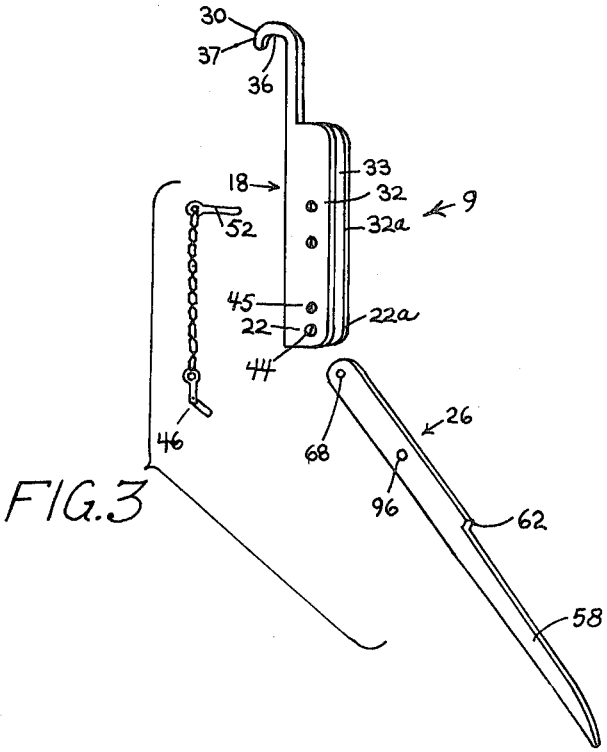
FIG. 3 is an exploded perspective view of the tool shown in FIG. 1.

An alternative embodiment of the disclosed tool is shown in FIG. 6. In the alternative embodiment, the base member 18' is substantially identical to the base member 18 shown in the embodiment of FIG. 3. (Primed numerals are used to indicate corresponding parts between the embodiments shown in FIGS. 3 and 6). However, in the embodiment shown in FIG. 6, the lug panels 32 and **32*a* of the embodiment shown in FIG. 3 are replaced by substantially smaller lug members 78 and 78*a* that extend laterally away from the base 18. These lugs 78 and 78*a* are provided with openings 82 and 83 (opening 83 not being shown in FIG. 6) through the thickness of the respective lugs. Further, the base 18' is provided with additional lug members 80 and 80*a* at the lower end thereof, the lugs 80 and 80*a* being provided with openings 44' and 44*a*', (opening 44*a*' not shown in FIG. 6**), through the thickness of the respective lugs.

In the embodiment shown in FIG. 6, an elongated arm 26' is pivotally received at its end 92 between the lugs 80 and **80*a*, the arm 26' being provided with an opening 68' through the thickness thereof which is positioned in register with the openings 44' and 44*a*' in the lugs 80 and 80*a* such that a lockpin 46' inserted therein provides for pivotal relationship of the arm 26' with respect to the base 18'. The arm 26' is "two-sided," one side being provided with a shoulder 62*a* and the opposite side being provided with a shoulder 62*b* at a location closer to the pivotal axis of the arm 26' than the shoulder 62*a*. As described hereinabove in connection with the embodiment shown in FIG. 3, the arm 26' is pivotable to a position wherein the opening 96' through the thickness of the arm 26' is in register with the openings 82 and 83 in the lugs 78 and 78*a* such that the insertion of the locking pin 52' through the registered openings locks the arm 26' relative to the base 18'. This establishes the position of the shoulder 62*a* adjacent to the base 18' such that the upper end 86 of the arm 26', the shoulder 62*a* and the base member 18'** cooperatively define a channel within which there may be received the bottom edge of a siding board as discussed hereinabove.

On the other hand, should it be desired that the bottom edge of the siding board be at a lower vertical position than that which would be established by the shoulder 62, the locking pin 46' can be withdrawn and the arm 26' rotated 180° about the longitudinal axis and repositioned in pivotal relation to base 18'. As thus repositioned, the shoulder **62*b* faces the base 18' and when the arm 26' is locked in position relative to the lugs 78 and 78*a*, there is formed a channel 100 between the upper portion 84 of the arm 26', the shoulder 62*b* and the base 18'**, such channel being suitable for receiving the bottom edge of a siding board therein.

In either of the rotated positions of the arm 26', upon withdrawing the locking pin 52, the arm 26' may be pivoted away from the siding board such that the tool can be rotated about the longitudinal axis of the base member 18', to position the hook 36' substantially parallel to the plane of siding boards whereupon the tool may be withdrawn from between the subjacent board and the freshly applied siding board.

Figure 7:
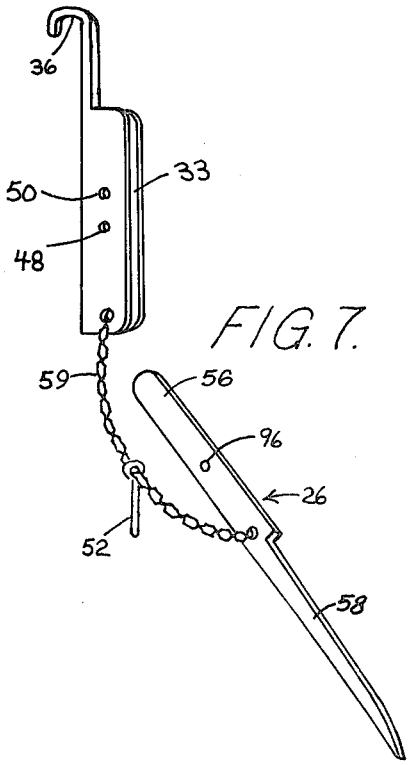
FIG. 7 is a perspective view of an alternative embodiment of a tool embodying various of the features of the invention.

In a further alternative embodiment of the disclosed tool, as shown in FIG. 7, a single locking pin 52 secures the arm 26 to the base 18 in the closed positions. The locations of the openings 48, 50 and 96 are adapted to place the lower portion 56 of the arm 26 in contact with the base 18 to prevent pivotal motion about the locking pin 52. A chain 59 secures the base 18 to the arm 26 as well as the locking pin 52.

In the construction of a building, a wooden framework 16 is generally built upon, and attached to a foundation 98. Siding is then attached to the external areas of the framework. In order to accomplish this attachment, an initial strip 20 is first attached in a horizontal position at the base of the framework 16 immediately adjacent to the foundation 98. Care is taken, such as through use of a level, to ensure that the initial strip is horizontal or, more generally, at the angle at which all siding boards are desirably attached.

As shown in FIG. 1, the upper end portion 30 of the base member 18 is hooked over the initial strip 20 to cause the base to lie along and proximate to the face of the strip. The arm 26 is then placed in an initial closed position in which the openings 48 and **48*a* (not shown) are aligned with the opening 96 through the arm and the openings 44 and 44*a* are aligned with the opening 68. The pivotal pin 46 and locking pin 52 are then inserted through the registered openings thereby fixing the base and arm relative to one another in the lower closed position. In this lower closed position, a channel 100 is formed by the upper portion 58 of the arm 26, the shoulder 62 and the base 18. The distance between the base and the arm, i.e., the width dimension of the channel 100 is adapted to slidably receive the lower edge 14 of a siding board 10. As shown in FIG. 4**, a second tool is similarly hung a substantial distance from the first tool, preferably adjacent the opposite end of the siding board.

With the tools in position as described, a siding board 10 is then inserted into the respective channels 100 of the spaced-apart tools to rest upon the shoulder 62 of the arm 26 of each tool. In this position, the board 10 is fully supported in a position parallel to the initial strip 20 because the tools are similar and the shoulder 62 of each tool is in a similar location relative to its respective hooked end portion 30. As thus positioned, the siding board 10 completely covers the initial strip 20 and overlaps a portion of the top of the foundation 98 to protect against seepage, etc. While the tools maintain the board in its proper orientation, the installer attaches the board to the framework 16 by means of nails, for example.

After the board is firmly attached, the locking pin 52 is removed, releasing the arm 26 to pivot away from the board 10. The tool is then withdrawn from the initial strip by slightly lifting, rotating it through about 90°, thus freeing the hooked end portion 30 (as shown in FIG. 5). The tool is then drawn downward from between the initial strip 20 and the board 10, freeing it for reuse. The second tool is similarly withdrawn. In the preferred embodiment, the degree of pivot of the arm 26 about the axis of the pivot pin 46 is at least about 90°, thereby allowing the desired rotation of the tool through 90° for withdrawal without arm 26 striking the freshly attached board. The pivot angle is preferably limited to less than about 180° in order to avoid accidental striking of previously attached boards by the arm if it is allowed to pivot freely.

Each of the first and second tools is then hooked over the upper edge 12 of the siding board 10 previously attached and the arm of each tool is placed in its closed position as shown in FIG. 2. In this position, the pivot pin 46 is passed through the registered openings 45, **45*a* and 68 and the locking pin 52 is passed through the registered openings 50, 50*a* and 96 to maintain the arm in position. As thus positioned, the arm 26, the ledge 62 and the base 18 define a channel 102. A second board 104 is then inserted into the channel 102 of each tool where it is maintained parallel to the subjacent board. The second board 104 is attached to the framework studs, and the tools are then withdrawn as shown in FIG. 5. The process is continued upwardly, using the channels 102**, until the top board is attached.

Use of the herein disclosed tool allows a single person to install siding in substantially the same amount of time two or more people require using prior methods. In addition, the tool is reusable, because it is not incorporated into the building, it avoids the extra time required for measuring and it eliminates the need for excess material in the form of lips, etc.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. A reusable tool for the installation, on a framework, of elongated horizontally overlapping siding boards, each board having an upper edge portion, a lower edge portion and an exposed outer face, comprising an elongated base member including a first end portion defining means for releasably engaging the upper edge portion of a first board and for supporting said base member in depending relationship from said upper edge and lying proximate to said exposed outer face of said first board, and a second end portion including lug means extending outwardly from said base member in a direction away from said outer face of said first board, an elongated arm means including a first end portion pivotally received by said lug means and extending therefrom to be movable to a closed position in which said arm means is substantially parallel to said base member but with its outboard end spaced apart from said base member to define a channel between said arm means and said base member suitable to receive therein the lower edge portion of a second board, and means for releasably securing said arm means to said lug means in said closed position.

2. A tool as described in claim 1 wherein said arm means projects above said base member first end portion when said arm means is in said position to define a channel.

3. A tool as described in claim 1 wherein said releasable securing means provides multiple secured positions of said arm means relative to said base means.

4. A tool as described in claim 3 wherein said releasable securing means comprises a plurality of openings defined within said lug means and said arm means, the locations of said openings providing a plurality of vertical positions of the arm means relative to the base means.

5. A tool as described in claim 1 wherein said arm means includes a shoulder which defines a portion of said channel and supports the lower edge portion of said second board to establish a predetermined vertical position of said second board relative to said support board.

6. A tool as described in claim 1 wherein said lug means comprise a set of side panels attached to said base means and spaced apart to define a channel adapted to receive said arm means.

7. A tool as described in claim 6 wherein a plurality of openings are defined within each of said side panels, each of said side panel openings being in register with an opening in another side panel and an opening defined in said pivotal arm means when said arm means is in a channel-defining position.

8. A tool as described in claim 1 wherein said securing means includes a lock pin, a plurality of registered openings defined within said lug means and an opening defined within said arm means, in register with said registered openings in said lug means, each of said registered lug means openings and said arm opening being adapted to receive said lock pin.

* * * * *